US010154556B2

(12) United States Patent
Lee

(10) Patent No.: US 10,154,556 B2
(45) Date of Patent: Dec. 11, 2018

(54) LED DRIVING CIRCUIT AND LED LIGHTING DEVICE

(71) Applicant: Seoul Semiconductor Co., Ltd., Ansan-si (KR)

(72) Inventor: Keon Young Lee, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 0 days.

(21) Appl. No.: 15/508,795

(22) PCT Filed: Aug. 31, 2015

(86) PCT No.: PCT/KR2015/009141
§ 371 (c)(1),
(2) Date: Mar. 3, 2017

(87) PCT Pub. No.: WO2016/036090
PCT Pub. Date: Mar. 10, 2016

(65) Prior Publication Data

US 2017/0280527 A1 Sep. 28, 2017

(30) Foreign Application Priority Data

Sep. 5, 2014 (KR) ..... 10-2014-0118695

(51) Int. Cl.
*H05B 33/08* (2006.01)

(52) U.S. Cl.
CPC ..... *H05B 33/0845* (2013.01); *H05B 33/083* (2013.01); *H05B 33/0815* (2013.01); *H05B 33/0827* (2013.01); *H05B 33/0857* (2013.01)

(58) Field of Classification Search
CPC combination set(s) only.
See application file for complete search history.

(56) References Cited

U.S. PATENT DOCUMENTS 8,598,796 B2 * 12/2013 Jeong ..... H05B 33/083 315/185 R
8,963,437 B2 2/2015 Wu et al.
(Continued)

FOREIGN PATENT DOCUMENTS

| | | |
|---|---|---|
| EP | 2640166 | 9/2013 |
| WO | 2013/040019 | 3/2013 |
| WO | 2013/082609 | 6/2013 |

OTHER PUBLICATIONS

International Search Report dated Dec. 15, 2015 in International Application No. PCT/KR2015/009141.
(Continued)

*Primary Examiner* — Douglas W Owens
*Assistant Examiner* — Jianzi Chen
(74) *Attorney, Agent, or Firm* — H.C. Park & Associates, PLC

(57) ABSTRACT

A light emitting diode (LED) driving circuit including a dimmer modulating an AC voltage input depending on a selected dimming level, a rectifying unit performing a full-wave rectification for an AC voltage to generate and output a driving voltage, first and second dimming level detecting units receiving the driving voltage of the rectifying unit to detect the selected dimming level, and outputting first and second dimming level signals depending on the detected dimming level, a first driving module controlling a first LED light emitting unit using the first dimming level signal of the first dimming level detecting unit, and a second driving module controlling a second LED light emitting unit using the second dimming level signal of the second dimming level detecting unit, in which the first and second driving modules control the first and second LED light emitting units, respectively.

24 Claims, 4 Drawing Sheets

(56) References Cited

U.S. PATENT DOCUMENTS

| | | | | |
|---|---|---|---|---|
| 2008/0224635 | A1 | 9/2008 | Hayes | |
| 2011/0248640 | A1 | 10/2011 | Welten | |
| 2012/0112651 | A1 | 5/2012 | King et al. | |
| 2013/0063035 | A1 | 3/2013 | Baddela et al. | |
| 2013/0234615 | A1* | 9/2013 | Wu | H05B 37/0263 315/201 |
| 2014/0210357 | A1* | 7/2014 | Yan | H05B 33/0824 315/186 |
| 2014/0217907 | A1* | 8/2014 | Harris | H05B 33/0815 315/186 |
| 2014/0361697 | A1 | 12/2014 | Miskin et al. | |

OTHER PUBLICATIONS

Written Opinion dated Dec. 15, 2015 in International Application No. PCT/KR2015/009141.

Extended European Search Report dated Jul. 4, 2018, in European Patent Application No. 15838969.2.

* cited by examiner

LED DRIVING CIRCUIT AND LED LIGHTING DEVICE

CROSS-REFERENCE TO RELATED APPLICATIONS

This application is the National Stage Entry of International Patent Application No. PCT/KR2015/009141, filed on Aug. 31, 2015, and claims priority from and the benefit of Korean Patent Application No. 10-2014-0118695, filed on Sep. 5, 2014, which are incorporated by reference for all purposes as if fully set forth herein.

BACKGROUND

Field

Exemplary embodiments relate to a light emitting diode (LED) driving circuit and an LED lighting device, and more particularly, to an LED driving circuit and an LED lighting device that may control a color temperature using a dimmer.

Discussion of the Background

Generally, a diode device for light emission such as a light emitting diode (LED) has been driven only by direct current (DC) power due to its diode characteristics. Therefore, a conventional light emitting apparatus using an LED has been restrictively used in that a separate circuit, such as a switching mode power supply (SMPS), is generally included in the light emitting apparatus in order to be driven by alternating current (AC) power of 220V that is currently used at home. As such, a circuit of the light emitting apparatus may become more complicated, and costs for manufacturing the light emitting apparatus may be increased.

In order to solve these problems, research of an LED that may be driven even by AC power has been conducted, for example, by connecting a plurality of light emitting cells in series with or in parallel to each other.

In addition, a sequential driving scheme of LEDs using AC power has been suggested. According to the sequential driving scheme, when a lighting device including three LED groups is applied with an increasing input voltage over time, a first LED group first starts to emit light at a first forward voltage level to a second forward voltage level higher than the first forward voltage level, a second LED group connected in series with the first LED group starts to emit light at the second forward voltage level to a third forward voltage level higher than the second forward voltage level, and a third LED group connected in series with the second LED group and the first LED group starts to emit light at the third forward voltage level to a fourth forward voltage level higher than the third forward voltage level.

When the lighting device is applied with a decreasing input voltage over time, the third LED group first stops emitting light at the second forward voltage level to the third forward voltage level, the second LED group stops emitting light at the first forward voltage level to the second forward voltage level, and the first LED group finally stops emitting light at a voltage is level equal to or less than the first forward voltage level. In this manner, an LED driving current of the lighting device may be approximated to the input voltage.

Such LEDs, which may be driven sequentially using general AC power, may be driven regularly, but have limited characteristics, for example, implementing only a predefined color temperature depending on the characteristics of the LEDs.

SUMMARY

Exemplary embodiments provide an LED driving circuit and an LED lighting device that may change a color temperature depending on a selection of a user.

According to an exemplary embodiment, a light emitting diode (LED) driving circuit includes a dimmer modulating an alternating current (AC) voltage input depending on a selected dimming level, a rectifying unit performing a full-wave rectification for an AC voltage to generate and output a driving voltage, first and second dimming level detecting units receiving the driving voltage of the rectifying unit to detect the selected dimming level, and outputting first and second dimming level signals depending on the detected dimming level, a first driving module controlling a first LED light emitting unit using the first dimming level signal of the first dimming level detecting unit, a second driving module controlling a second LED light emitting unit using the second dimming level signal of the second dimming level detecting unit, in which the first driving module and the second driving module perform the first and second LED light emitting units, respectively.

The first and second LED light emitting units may be driven to be inversely proportionate to each other, and the first and second dimming level signals are direct current (DC) signals having constant voltage values that are inversely proportionate to each other.

The first driving module may sequentially drive the first LED light emitting unit during a plurality of sections depending on the modulated AC voltage.

The second driving module may sequentially drive the second LED light emitting unit during a plurality of sections depending on the modulated AC voltage.

The second driving module may include a pulse width modulating unit generating a pulse width modulated signal, and the second LED light emitting unit may be driven by the pulse width modulated signal.

The dimmer may be any one of a triode for alternating current (TRIAC) dimmer controlling a phase of AC power using a TRIAC, a pulse width modulation (PWM) dimmer, and an analog voltage dimmer changing the AC voltage.

According to an exemplary embodiment, a light emitting diode (LED) driving circuit includes a first rectifying unit performing a full-wave rectification for an alternating current (AC) voltage input from an AC voltage source to generate and output a first driving voltage, a first driving module responding to the first driving voltage to regularly and sequentially drive a first LED light emitting unit, a dimmer modulating the AC voltage input from the AC voltage source depending on a selected dimming level, a second rectifying unit performing a full-wave rectification for an AC voltage to generate and output a second driving voltage, a dimming level detecting unit receiving the second driving voltage of the second rectifying unit to detect the selected dimming level and outputting a dimming level signal depending on the detected dimming level, and a second driving module controlling a second LED light emitting unit using the dimming level signal of the dimming level detecting unit.

The second driving module may sequentially drive the second LED light emitting unit during a plurality of sections depending on the modulated AC voltage.

The second driving module may include a pulse width modulating unit generating a pulse width modulated signal, and the pulse width modulated signal may drive the second LED light emitting unit.

The dimmer may be any one of a TRIAC dimmer controlling a phase of AC power using a TRIAC, a pulse width modulation (PWM) dimmer, and an analog voltage dimmer changing the AC voltage.

The dimmer may be a TRIAC dimmer and may be classified into a plurality of sections depending on phase-modulated magnitude.

According to an exemplary embodiment, a light emitting diode (LED) lighting device includes a dimmer modulating an alternating current (AC) voltage input depending on a selected dimming level, a rectifying unit performing a full-wave rectification for an AC voltage to generate and output a driving voltage, first and second dimming level detecting units receiving the driving voltage of the rectifying unit to detect the selected dimming level and outputting first and second dimming level signals depending on the detected dimming level, a first driving module controlling a first LED light emitting unit using the first dimming level signal of the first dimming level detecting unit, a second driving module controlling a second LED light emitting unit using the second dimming level signal of the second dimming level detecting unit, a first LED light emitting unit emitting light according to a control of the first driving module, and a second LED light emitting unit emitting light according to a control of the second driving module.

The first and second LED light emitting units may be driven to be inversely proportionate to each other, and the first and second dimming level signals may be direct current (DC) signals having constant voltage values that are inversely proportionate to each other.

The first driving module may sequentially drive the first LED light emitting unit during a plurality of sections depending on the modulated AC voltage.

The second driving module may sequentially drive the second LED light emitting unit during a plurality of sections depending on the modulated AC voltage.

The second driving module may include a pulse width modulating unit generating a pulse width modulated signal, and the second LED light emitting unit may be driven by the pulse width modulated signal.

The dimmer may be any one of a TRIAC dimmer controlling a phase of AC power using a TRIAC, a pulse width modulation (PWM) dimmer, and an analog voltage dimmer changing the AC voltage.

The second LED light emitting unit may include a red LED.

According to an exemplary embodiment, a light emitting diode (LED) lighting device includes a first rectifying unit performing a full-wave rectification for an alternating current (AC) voltage input from an AC voltage source to generate and output a first driving voltage, a first driving module responding to the first driving voltage to regularly and sequentially drive a first LED light emitting unit, a dimmer modulating the AC voltage input from the AC voltage source depending on a selected dimming level, a second rectifying unit performing a full-wave rectification for an AC voltage to generate and output a second driving voltage, a dimming level detecting unit receiving the second driving voltage of the second rectifying unit to detect the selected dimming level and outputting a dimming level signal depending on the detected dimming level, a second driving module controlling a second LED light emitting unit using the dimming level signal of the dimming level detecting unit, a first LED light emitting unit emitting light according to a control of the first driving module, and a second LED light emitting unit emitting light according to a control of the second driving module.

The second driving module may sequentially drive the second LED light emitting unit during a plurality of sections depending on the modulated AC voltage.

The second driving module may include a pulse width modulating unit generating a pulse width modulated signal, and the second LED light emitting unit may be driven by the pulse width modulated signal.

The dimmer may be any one of a TRIAC dimmer controlling a phase of AC power using a TRIAC, a pulse width modulation (PWM) dimmer, and an analog voltage dimmer changing the AC voltage.

The dimmer may be a TRIAC dimmer and may be classified into a plurality of sections depending on phase-modulated magnitude.

The second LED light emitting unit may include a red LED.

Although various exemplary embodiments have been described hereinabove, the present invention is not limited to the specific exemplary embodiments. In addition, components described in the specific exemplary embodiments may be similarly applied to other exemplary embodiments without departing from the spirit of the present invention.

BRIEF DESCRIPTION OF THE DRAWINGS

The accompanying drawings, which are included to provide a further understanding of the disclosed technology, and are incorporated in and constitute a part of this specification, illustrate exemplary embodiments of the disclosed technology, and together with the description serve to describe the principles of the disclosed technology.

DETAILED DESCRIPTION OF THE ILLUSTRATED EMBODIMENTS

Figure 1:
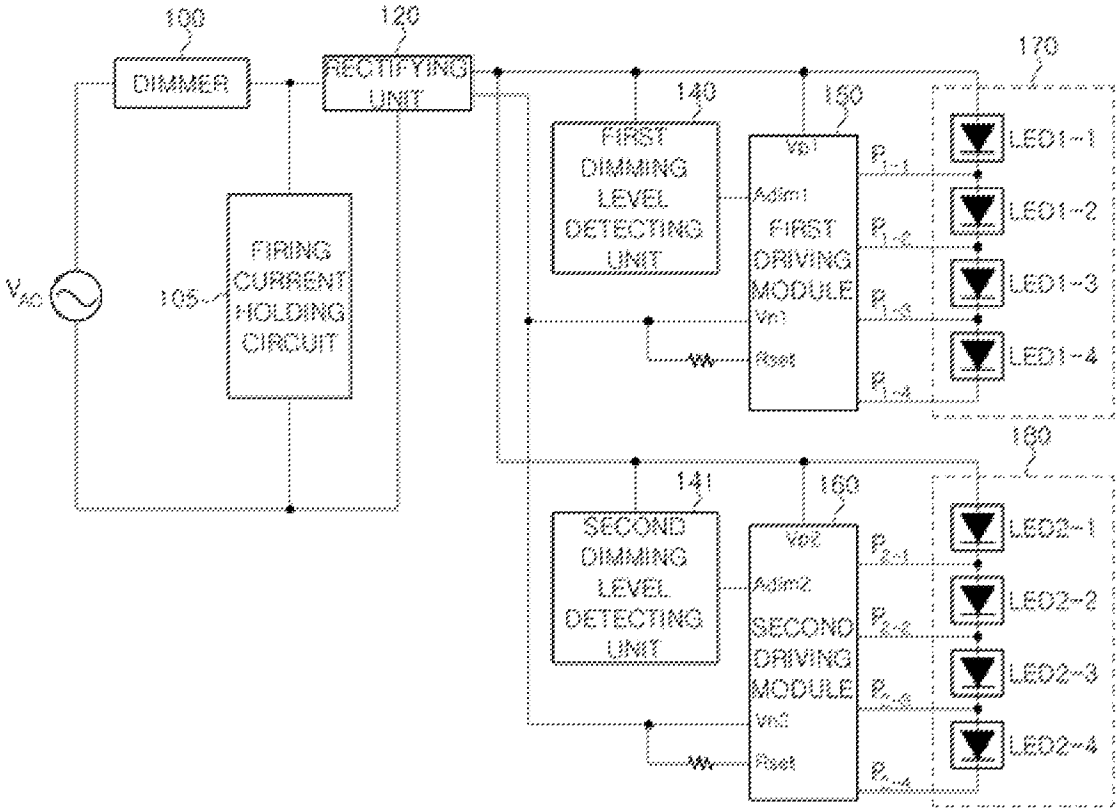
FIG. 1 is a view illustrating a configuration of a light emitting diode (LED) lighting device according to an exemplary embodiment.

Exemplary embodiments of the present invention will be described in detail with reference to the accompanying drawings. These exemplary embodiments will be described in detail for those skilled in the art in order to practice the present invention. It should be appreciated that various exemplary embodiments of the present invention are different from each other, but do not have to be exclusive. For example, specific shapes, structures, and characteristics described in the present specification may be implemented in another exemplary embodiment without departing from the spirit and the scope of the present invention in connection with an exemplary embodiment. In addition, it should be understood that position and arrangement of individual components in each disclosed exemplary embodiment may be changed without departing from the spirit and the scope of the present invention. Therefore, a detailed description to be described below should not be construed as being restrictive. In addition, the scope of the present invention is defined only by the accompanying claims and their equivalents if appropriate. Similar reference numerals will be used to describe the same or is similar functions throughout the accompanying drawings.

FIG. 1 is a view illustrating a configuration of a light emitting diode (LED) lighting device according to an exemplary embodiment. As used herein, an LED lighting device according to exemplary embodiments may be driven by a color temperature controllable alternating current (AC), and may also be referred to as "a color temperature controllable AC driven LED lighting device."

Referring to FIG. 1, a color temperature controllable AC driven LED lighting device according an exemplary embodiment includes a dimmer 100, a firing current holding circuit 105, a rectifying unit 120, a first dimming level detecting unit 140, a second dimming level detecting unit 141, a first driving module 150, a second driving module 160, and first and second LED light emitting units 170 and 180. The LED lighting device may control a color temperature based on a selection of a user using the dimmer 100. More particularly, the driving of the first and second LED light emitting units 170 and 180 are separately controlled based on an alternating current (AC) voltage modulated by the dimmer 100, such that the color temperature may be changed.

The dimmer 100 receives an AC voltage ($V_{AC}$) from an AC voltage source. The dimmer 100 generates and outputs AC power obtained by modulating the input AC voltage ($V_{AC}$) to a dimming level selected by a manipulation of the user. The dimmer 100 may be one of a triode for alternating current (TRIAC) dimmer controlling a phase of AC power using a TRIAC, a pulse width modulation (PWM) dimmer, an analog voltage dimmer changing an AC voltage, and dimmers equivalent thereto. That is, the dimmer 100 may be any kinds of dimmer that may generate and output the AC voltage obtained by modulating the AC voltage depending on the selected dimming level, and allow the selected dimming level to be detected by the dimming level detecting unit 140 from the AC voltage modulated by the dimmer 100. According to exemplary embodiments, the dimmer 100 will be described with reference to the TRIAC dimmer. However, the inventive concept is not limited thereto.

The dimmer 100 receives the AC voltage ($V_{AC}$) from the AC voltage source and generates an AC voltage obtained by phase-modulating the input AC voltage ($V_{AC}$) depending on the dimming level selected by the manipulation of the user. The dimmer 100 generates a phase-controlled AC voltage by phase-modulating the AC voltage ($V_{AC}$) depending on the dimming level selected by the user. Here, since the TRIAC dimmer is a well known in the art, a detailed description thereof will be omitted.

The LED lighting device according to an exemplary embodiment may further include a firing current holding circuit 105 connected between the dimmer 100 and the rectifying unit 120, and allow the TRIAC firing current to flow to an AC power input or a rectified voltage output, or acting as a dummy load. For example, the firing current holding circuit 105 may be a bleeder circuit including a bleeder capacitor and a bleeder resistor connected in series with the bleeder capacitor. However, the inventive concept is not limited to any particular type of a circuit, and the firing current holding circuit 105 may include, for example, one of voltage stabilization circuits.

The rectifying unit 120 rectifies the phase-modulated AC voltage to generate a driving voltage, and outputs the generated driving voltage. The rectifying unit 120 is not particularly limited, and one of various known rectifying circuits, such as a full-wave rectifying circuit, a half-wave rectifying circuit, and the like, may be used. For example, the rectifying unit 120 may be a bridge full-wave rectifying circuit including four diodes.

Each of the first and second dimming level detecting units 140 and 141 may detect the currently selected dimming level based on the driving voltage provided from the rectifying unit 120, and output first and second dimming level signals $A_{dim1}$ and $A_{dim2}$ to the first and second driving modules 150 and 160, respectively, depending on the detected dimming level. More specifically, the first and second dimming level detecting units 140 and 141 according to an exemplary embodiment may average the driving voltage ($V_P$), of which a voltage level is changed over time, to detect the dimming level. Since the dimmer 100 is configured to cut the phase of the AC voltage ($V_{AC}$) depending on the dimming level selected by the user, when the driving voltage is averaged, the currently selected dimming level may be detected. The first and second dimming level signals $A_{dim1}$ and $A_{dim2}$ may be direct current (DC) signals having a constant voltage value corresponding to the dimming level. The first and second dimming level signals $A_{dim1}$ and $A_{dim2}$ have values that are inversely proportionate to each other. For example, when the dimming level is 80%, the first dimming level signal $A_{dim1}$ may be 1.8V corresponding to the dimming level of 80%, and the second dimming level signal $A_{dim2}$ may be 0.2V, which is inversely proportionate to the first dimming level signal $A_{dim1}$. When the dimming level is 20%, the first dimming level signal $A_{dim1}$ may be 0.2V corresponding to the dimming level of 20%, and the second dimming level signal $A_{dim2}$ may be 1.8V, which is inversely proportionate to the first dimming level signal $A_{dim1}$. Here, when the dimming level is 50%, the first dimming level signal $A_{dim1}$ may be 1.0V corresponding to the dimming level of 50%, and the second dimming level signal $A_{dim2}$ may be 1.0V, which is inversely proportionate to the first dimming level signal $A_{dim1}$.

The first driving module 150 may respond to the first dimming level signal $A_{dim}$ to control the first LED light emitting unit 170. For example, the first driving module 150 sequentially drives first LED groups (LED 1-1 to LED 1-4) during a plurality of sections (e.g., is first to seventh sections). The first section may be defined as a section, in which the voltage level of the driving voltage input from the rectifying unit 120 is between a first forward voltage level and a second forward voltage level, and only a first current path P1-1 is connected to the first driving module 150 during the first section, such that a 1-1 LED group LED1-1 emits light. In addition, the second section may be defined as a section, in which the voltage level of the driving voltage input from the rectifying unit 120 is between the second forward voltage level and a third forward voltage level, and a second current path P1-2 is connected to the first driving module 150 during the second section, such that 1-1 and 2-1 LED groups LED1-1 and LED1-2 emit light. The third section may be defined as a section, in which the voltage level of the driving voltage input from the rectifying unit 120 is between the third forward voltage level and a fourth forward voltage level, and a third current path P1-3 is connected to the first driving module 150 during the third section, such that 1-1$^{th}$ to 1-3$^{th}$ LED groups LED 1-1 to LED 1-3 emit light. The fourth section may be defined as a section, in which the voltage level of the driving voltage input from the rectifying unit 120 is the fourth forward voltage level, and a fourth current path P1-4 is connected to the first driving module 150 during the fourth section, such that the first LED groups LED1-1 to LED1-4 emit light.

The fifth section may be defined as a section, in which the voltage level of the driving voltage input from the rectifying unit 120 is between the fourth forward voltage level and a third forward voltage level, and the third current path P1-3 is connected to the first driving module 150 during the fifth section, such that the 1-1$^{th}$ to 1-3$^{th}$ LED groups LED1-1 to LED1-3 emit light. The sixth section may be defined as a section, in which the voltage level of the driving voltage input from the rectifying unit 120 is between the third forward voltage level and the second forward voltage level, and the second current path P1-2 is connected to the first driving module 150 during the sixth section, such that the 1-1$^{th}$ and 1-2$^{th}$ LED groups LED1-1 and LED1-2, emit light. The seventh section may be defined as a section, in which the voltage level of the driving voltage input from the rectifying unit 120 is between second forward voltage level and the first forward voltage level, and only the first current path P1-1 is connected to the first driving module 150 during the seventh section, such that the 1-1$^{th}$ LED group LED1-1 emits light.

The first and seventh sections may be defined as a first stage driving section, the second and sixth sections may be defined as a second stage driving section, the third and fifth sections may be defined as a third stage driving section, and a fourth section may be defined as a fourth stage driving section. The first LED groups LED1-1 to LED1-4 may have different forward voltage levels from each other. For example, when the first LED groups LED1-1 to LED1-4 each includes different number of LEDs, the first LED groups LED1-1 to LED1-4 may have the different forward voltage levels from each other. The first LED light emitting unit 170 may sequentially emit light so as to correspond to the phase-modulated AC voltage depending on the first dimming level signal $A_{dim1}$ of the first driving module 150, and may implement cool white.

The second driving module 160 may respond to the second dimming level signal $A_{dim2}$ to control the second LED light emitting unit 180. For example, the second driving module 160 may sequentially drive second LED groups (LED2-1 to LED2-4) during a plurality of sections (e.g., first to seventh sections). Since the sequential driving of the second LED light emitting unit 180 may be substantially the same as that described above with reference to the first driving module 150 and the first LED light emitting unit 170, repeated description of the substantially the same sequential driving method will be omitted.

Although not shown, the second driving module 160 may further include a pulse-width modulating unit. The second LED light emitting unit 180 may be driven to correspond to a pulse-width modulated signal from the second driving module 160. For example, the second LED light emitting unit 180 may include of red LEDs and may implement warm white.

The LED lighting device according to an exemplary embodiment may control the driving of the first and second LED light emitting units 170 and 180, depending on the dimming level selected by the control of the dimmer 100. In this manner, the LED lighting device may control a driving ratio of the first LED light emitting unit 170 implementing cool white and the second LED light emitting unit 180 implementing warm white, such that the color temperature may be controlled.

Figure 2:
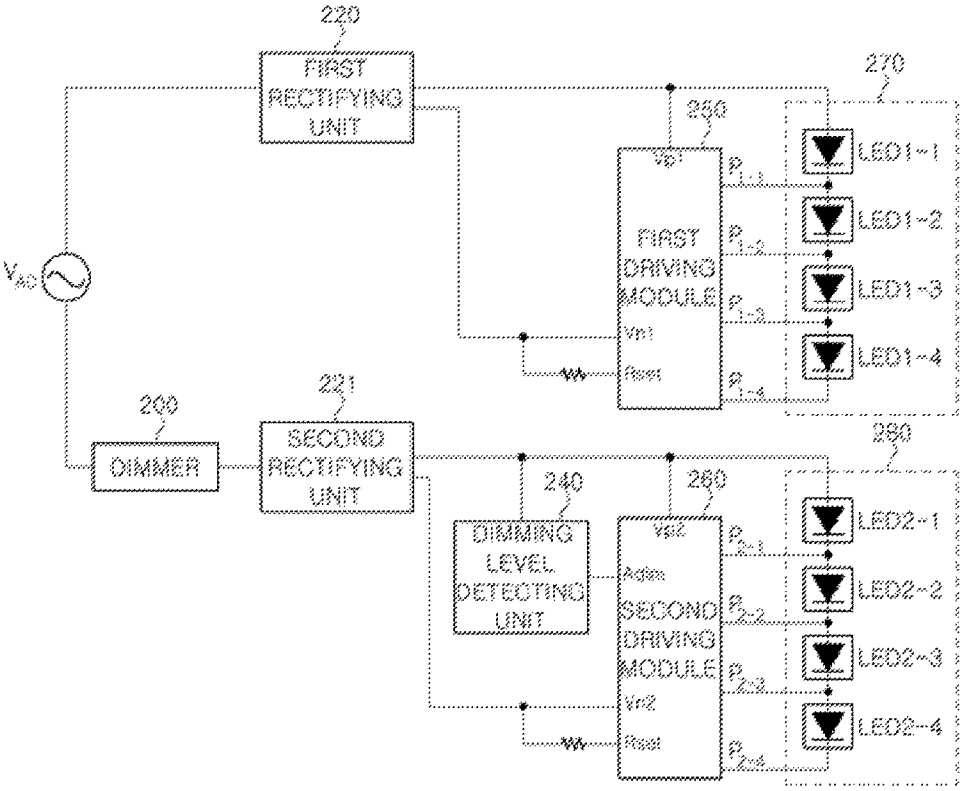
FIG. 2 is a view illustrating a configuration of an lighting device according to an exemplary embodiment.

FIG. 2 is a view illustrating a configuration of an LED lighting device according to an exemplary embodiment.

Referring to FIG. 2, a color temperature controllable AC driven LED lighting device according to an exemplary embodiment includes a first rectifying unit 220, a first driving module 250, and a first LED light emitting unit 270. The LED lighting device further includes a dimmer 200, a second rectifying unit 221, a dimming level detecting unit 240, a second driving module 260, and a second LED light emitting unit 280.

The LED lighting device may separately control the first driving module 250 driving the first LED light emitting unit 270 and the second driving module 260 driving the second LED light emitting unit 280, depending on a dimming level selected by a user for controlling a color temperature. In particular, the AC voltage modulated by the dimmer 200 (e.g., the phase-modulated AC voltage) is supplied to the second LED light emitting unit 280 adjusting the color temperature, thereby changing the color temperature. Here, the second LED light emitting unit 280 may include a red LED.

The first rectifying unit 220 receives an AC voltage $V_{AC}$ from an AC voltage source, rectifies the AC voltage to generate a driving voltage, and outputs the generated driving voltage. The first rectifying unit 220 is not particularly limited, and one of the various known rectifying circuits, such as a full-wave rectifying circuit, a half-wave rectifying circuit, and the like, may be used. For example, the first rectifying unit 220 may be a bridge full-wave rectifying circuit including four diodes.

The first driving module 250 may respond to the driving voltage input from the first rectifying unit 220 to control the first LED light emitting unit 270. For example, the first driving module 250 may sequentially drive first LED groups (LED1-1 to LED1-4) during a plurality of sections (e.g., first to seventh sections). Since the sequential driving of the first LED light emitting unit 270 is substantially the same as that described above with reference to the LED lighting device of FIG. 1, repeated description thereof will be omitted.

The dimmer 200 may receive the AC voltage ($V_{AC}$) from the AC voltage source and generates an AC voltage obtained by phase-modulating the input AC voltage ($V_{AC}$) depending on the dimming level selected by the manipulation of the user. Here, the dimming level corresponds to the color temperature. The dimmer 200 may be one of a TRIAC dimmer controlling a phase of AC power using a TRIAC, a pulse width modulation (PWM) dimmer, an analog voltage dimmer changing an AC voltage, and dimmers equivalent thereto. That is, the dimmer 200 may be any kinds of dimmer that may generate and output the AC voltage obtained by modulating the AC voltage depending on the selected dimming level, and allow the selected dimming level to be detected by the dimming level detecting unit 240 from the AC voltage modulated by the dimmer 200. Hereinafter, the dimmer 200 will be described with reference to is the TRIAC dimmer. However, the inventive concept is not limited thereto.

The second rectifying unit 221 may rectify the phase-modulated AC voltage to generate a driving voltage and output the generated driving voltage. The second rectifying unit 221 is not particularly limited, and one of various known rectifying circuits, such as a full-wave rectifying circuit, a half-wave rectifying circuit, and the like, may be used. For example, the second rectifying unit 221 may be a bridge full-wave rectifying circuit including four diodes.

The dimming level detecting unit 240 may detect the currently selected dimming level based on the driving voltage provided from the second rectifying unit 221, and output a dimming level signal $A_{dim}$, to the second driving module 260 depending on the detected dimming level. More specifically, the dimming level detecting unit 240 according to an exemplary may average the driving voltage, of which a level thereof is changed over time, to detect the dimming level. Since the dimmer 200 is configured to cut the phase of the AC voltage ($V_{AC}$) depending on the dimming level selected by the user, when the driving voltage is averaged, the currently selected dimming level may be detected. The dimming level signal $A_{dim}$, may be a direct current (DC) signal having a constant voltage value corresponding to the dimming level.

The second driving module 260 may respond to the dimming level signal $A_{dim}$ and control the second LED light emitting unit 280. For example, the second driving module 260 may sequentially drive second LED groups (LED2-1 to LED2-4) during a plurality of sections (e.g., first to seventh sections). Since the sequential driving of the second LED light emitting unit 280 is substantially the same as that described of the LED lighting device of FIG. 1, repeated description thereof will be omitted.

According to an exemplary embodiment, the second driving module 260 may further include a pulse width modulating unit (not shown), and the second LED light emitting units may be connected in series with each other to be simultaneously driven, and may respond to a pulse width modulated signal from the pulse width modulating unit. For example, the second LED light emitting units may include red LEDs and may implement warm white.

The LED lighting device according to an exemplary embodiment may control the driving of the second LED light emitting unit 280 depending on the dimming level selected by the control of the dimmer 200. In this manner, the LED lighting device may control the driving of the second LED light emitting unit 280 implementing warm white simultaneously with the driving of the first LED light emitting unit 270 implementing cool white, thereby controlling a color temperature.

Figure 3:
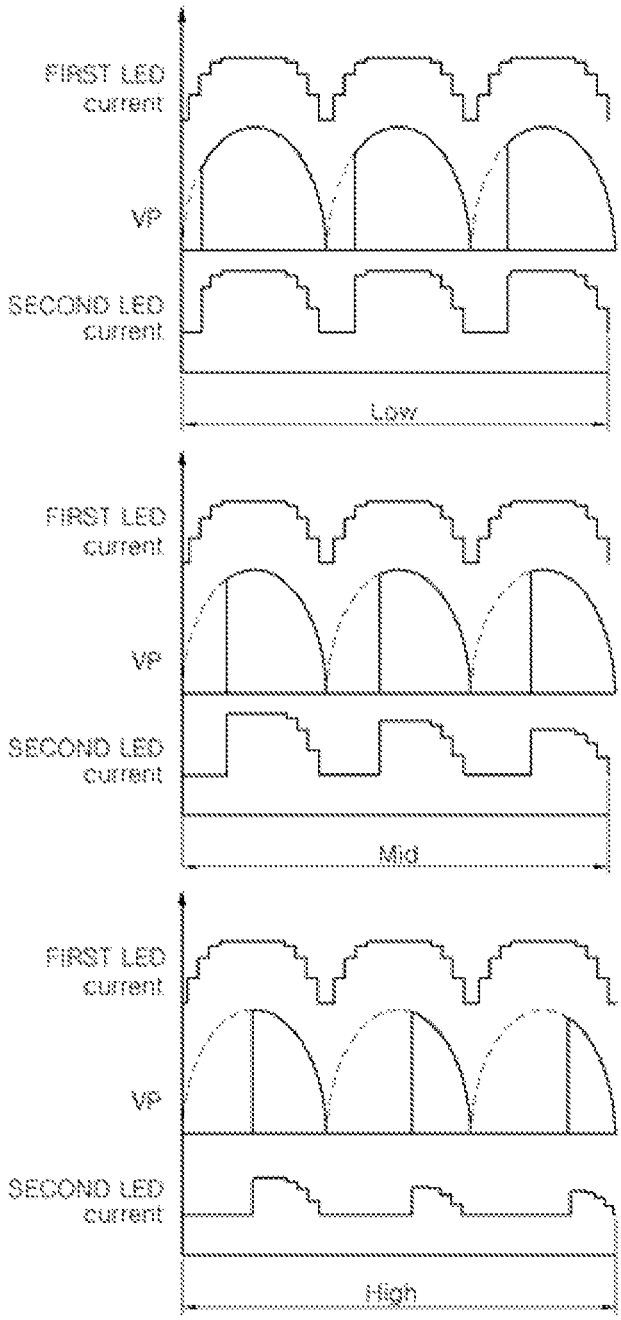
FIG. 3 is a waveform diagram illustrating a relationship between a driving voltage and a driving current of the LED lighting device of FIG. 2.

FIG. 3 is a waveform diagram illustrating a relationship between a driving voltage and a driving current of the LED lighting device of FIG. 2.

Referring to FIG. 3, the LED lighting device according to an exemplary embodiment may receive the AC voltage $V_{AC}$ from the AC voltage source, and respond to the driving voltage generated by rectifying the AC voltage $V_{AC}$ to sequentially drive the first LED light emitting unit. For example, the first LED light emitting unit is sequentially driven during a plurality of sections (e.g., first to seventh sections) within one period.

As shown in graphs of a first LED current, the first LED light emitting unit is regularly and sequentially driven within one period.

Meanwhile, an AC voltage $V_p$ having a phase modulated by the dimmer depending on the selection of the user, may be classified into a plurality of sections (e.g., first to third sections) depending on phase-modulated magnitude. Here, the plurality of sections are not limited to the first to third sections, but may be classified into four or more sections. For example, the first to third sections may further include a plurality sub-sections. According to an exemplary embodiment, the AC voltage is classified into a low section, a mid section, and a high section depending on the phase-modulated magnitude.

The second LED light emitting unit may respond to the driving voltage, which may be obtained by rectifying the phase-modulated AC voltage, to be sequentially driven. Here, the second LED light emitting unit varies an ON section of the driving voltage and current level amplitude depending on the phase-modulated magnitude.

As shown in graphs of a second LED current, the second LED light emitting unit has different ON sections and current level amplitudes depending on the phase-modulated magnitude within one period.

Figure 4:
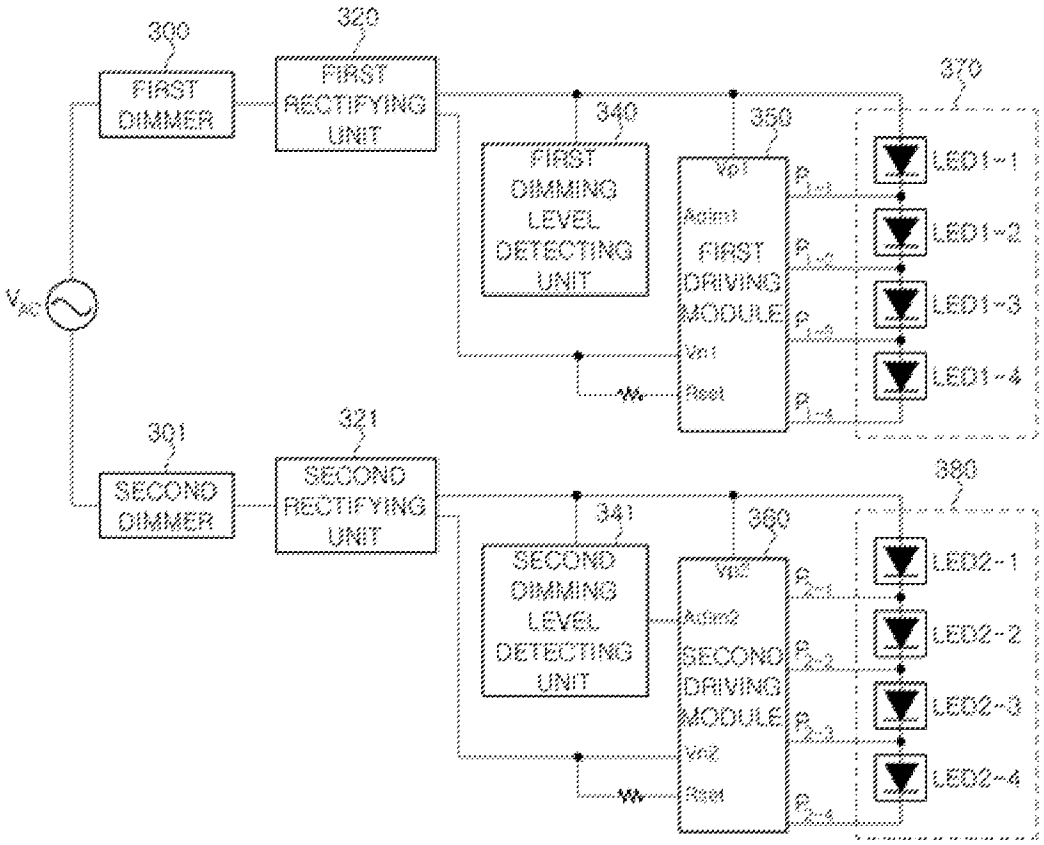
FIG. 4 is a view illustrating a configuration of an LED lighting device according to an exemplary embodiment.

FIG. 4 is a view illustrating a configuration of an LED lighting device according to an exemplary embodiment.

Referring to FIG. 4, an LED lighting device according to an exemplary embodiment includes first and second dimmers 300 and 301, first and second rectifying units 320 and 321, first and second dimming level detecting units 340 and 341, first and second driving modules 350 and 360, and first and second LED light emitting units 370 and 380. The LED lighting device may control luminance and a color temperature depending on a selection of a user using the first and second dimmers 300 and 301. More particularly, driving the first LED light emitting unit 370 is controlled based on an alternating current (AC) voltage modulated by the first dimmer 300, such that luminance may be changed. Here, the first LED light emitting unit 370 may emit blue LED light and include a yellow phosphor, in order to implement white.

The driving of the second LED light emitting unit 380 is controlled based on an AC voltage modulated by the second dimmer 301, such that the color temperature may be changed. Here, the second LED light emitting unit 380 may include a red LED. The first and is second driving modules 350 and 360 may selectively enable and disable a dimming control.

Since the first and second dimmers 300 and 301, the first and second rectifying units 320 and 321, the first and second dimming level detecting units 340 and 341, the first and second driving modules 350 and 360, and the first and second LED light emitting units 370 and 380 are substantially the same as those described above with reference to the LED lighting device of FIG. 1, repeated descriptions thereof will be omitted.

The LED lighting device according to an exemplary embodiment may control the driving of the first LED light emitting unit 370 depending on the dimming level selected by the control of the first dimmer 300, to stably control an overall luminance. The LED lighting device may further control the driving of the second LED light emitting unit 380 depending on the dimming level selected by the control of the second dimmer 301, to control the color temperature.

According to the exemplary embodiments, an LED driving circuit and a lighting device control the driving of the first and second LED light emitting units, depending on the dimming level selected by the control of the dimmer, to control the driving ratio of the first LED light emitting unit implementing cool white and the second LED light emitting unit implementing warm white, such that the color temperature may be controlled by the dimmer.

According to the exemplary embodiments, an LED lighting device controls the driving of the second LED light emitting unit depending on the dimming level selected by the control of the dimmer to control the driving of the second LED light emitting unit implementing warm white simultaneously with the driving of the first LED light emitting unit implementing cool white, such that the color temperature may be controlled by the dimmer.

According to exemplary embodiments, a LED lighting device may control the driving of the first LED light emitting unit depending on the dimming level selected by the control of the first dimmer to stably control an overall luminance, and control the driving of the second LED light emitting unit depending on the dimming level selected by the control of the second dimmer to control the color temperature using the dimmer.

Although various exemplary embodiments have been described hereinabove, the present invention is not limited to the specific exemplary embodiments. In addition, components described in the specific exemplary embodiments may be similarly applied to other exemplary embodiments without departing from the spirit of the present invention.

The invention claimed is:

1. A light emitting diode (LED) driving circuit comprising:

a dimmer modulating an alternating current (AC) voltage input depending on a selected dimming level and output a phase-modulated AC voltage;

a rectifying unit disposed downstream of the dimmer to perform a full-wave rectification for the phase-modulated AC voltage received to generate and output a driving voltage;

first and second dimming level detecting units receiving the driving voltage of the rectifying unit to detect the selected dimming level, and outputting first and second dimming level signals depending on the detected dimming level;

a first driving module controlling a first LED light emitting unit using the first dimming level signal of the first dimming level detecting unit; and a second driving module controlling a second LED light emitting unit using the second dimming level signal of the second dimming level detecting unit, wherein the first driving module and the second driving module control the first and second LED light emitting, respectively.

2. The LED driving circuit of claim 1, wherein:

the first and second LED light emitting units are driven to be inversely proportionate to each other; and the first and second dimming level signals are direct current (DC) signals having constant voltage values that are inversely proportionate to each other.

3. The LED driving circuit of claim 1, wherein the first driving module sequentially drives the first LED light emitting unit during a plurality of sections depending on the modulated AC voltage.

4. The LED driving circuit of claim 1, wherein the second driving module sequentially drives the second LED light emitting unit during a plurality of sections depending on the modulated AC voltage.

5. The LED driving circuit of claim 1, wherein:

the second driving module comprises a pulse width modulating unit generating a pulse width modulated signal; and the second LED light emitting unit is driven by the pulse width modulated signal.

6. The LED driving circuit of claim 1, wherein the dimmer is any one of a triode for alternating current (TRIAC) dimmer controlling a phase of AC power using a TRIAC, a pulse width modulation (PWM) dimmer, and an analog voltage dimmer changing the AC voltage.

7. A light emitting diode (LED) driving circuit comprising:

a first rectifying unit performing a full-wave rectification for an alternating current (AC) voltage input from an AC voltage source to generate and output a first driving voltage;

a first driving module responding to the first driving voltage to regularly and sequentially drive a first LED light emitting unit;

a dimmer modulating the AC voltage input from the AC voltage source depending on a selected dimming level;

a second rectifying unit performing a full-wave rectification for an AC voltage to generate and output a second driving voltage;

a dimming level detecting unit receiving the second driving voltage of the second rectifying unit to detect the selected dimming level, and outputting a dimming level signal depending on the detected dimming level; and a second driving module controlling a second LED light emitting unit using the dimming level signal of the dimming level detecting unit, wherein driving of the first LED light emitting unit by the first driving voltage and driving of the second LED light emitting unit by the dimming level signal are controlled simultaneously.

8. The LED driving circuit of claim 7, wherein the second driving module sequentially drives the second LED light emitting unit during a plurality of sections depending on the modulated AC voltage.

9. The LED driving circuit of claim 7, wherein:

the second driving module comprises a pulse width modulating unit generating a pulse width modulated signal; and the pulse width modulated signal drives the second LED light emitting unit.

10. The LED driving circuit of claim 7, wherein the dimmer is any one of a triode for alternating current (TRIAC) dimmer controlling a phase of AC power using a TRIAC, a pulse width modulation (PWM) dimmer, and an analog voltage dimmer changing the AC voltage.

11. The LED driving circuit of claim 7, wherein the dimmer is a triode for alternating current (TRIAC) dimmer and is classified into a plurality of sections depending on phase-modulated magnitude.

12. A light emitting diode (LED) lighting device comprising:

a dimmer modulating an alternating current (AC) voltage input depending on a selected dimming level and output a phase-modulated AC voltage;

a rectifying unit disposed downstream of the dimmer to perform a full-wave rectification for the phase-modulated AC voltage to generate and output a driving voltage;

first and second dimming level detecting units receiving the driving voltage of the rectifying unit to detect the selected dimming level, and outputting first and second dimming level signals depending on the detected dimming level;

a first driving module controlling a first LED light emitting unit using the first dimming level signal of the first dimming level detecting unit;

a second driving module controlling a second LED light emitting unit using the second dimming level signal of the second dimming level detecting unit;

the first LED light emitting unit emitting light according to a control of the first driving module; and the second LED light emitting unit emitting light according to a control of the second driving module, wherein driving of the first LED light emitting unit by the first driving voltage and driving of the second LED light emitting unit by the dimming level signal are controlled simultaneously.

13. The LED lighting device of claim 12, wherein:

the first and second LED light emitting units are driven to be inversely proportionate to each other; and the first and second dimming level signals are direct current (DC) signals having constant voltage values that are inversely proportionate to each other.

14. The LED lighting device of claim 12, wherein the first driving module sequentially drives the first LED light emitting unit during a plurality of sections depending on the modulated AC voltage.

15. The LED lighting device of claim 12, wherein the second driving module sequentially drives the second LED light emitting unit during a plurality of sections depending on the modulated AC voltage.

16. The LED lighting device of claim 12, wherein:

the second driving module comprises a pulse width modulating unit generating a pulse width modulated signal; and the second LED light emitting unit is driven by the pulse width modulated signal.

17. The LED lighting device of claim 12, wherein the dimmer is any one of a triode for alternating current (TRIAC) dimmer controlling a phase of AC power using a TRIAC, a pulse width modulation (PWM) dimmer, and an analog voltage dimmer changing the AC voltage.

18. The LED lighting device of claim 12, wherein the second LED light emitting unit comprises a red LED.

19. A light emitting diode (LED) lighting device comprising:

a first rectifying unit performing a full-wave rectification for an alternating current (AC) voltage input from an AC voltage source to generate and output a first driving voltage;

a first driving module responding to the first driving voltage to regularly and sequentially drive a first LED light emitting unit;

a dimmer modulating the AC voltage input from the AC voltage source depending on a selected dimming level;

a second rectifying unit performing a full-wave rectification for an AC voltage to generate and output a second driving voltage;

a dimming level detecting unit receiving the second driving voltage of the second rectifying unit to detect the selected dimming level, and outputting a dimming level signal depending on the detected dimming level;

a second driving module controlling a second LED light emitting unit using the dimming level signal of the dimming level detecting unit;

the first LED light emitting unit emitting light according to a control of the first driving module; and the second LED light emitting unit emitting light according to a control of the second driving module, wherein driving of the first LED light emitting unit by the first driving voltage and driving of the second LED light emitting unit by the dimming level signal are controlled simultaneously.

20. The LED lighting device of claim 19, wherein the second driving module sequentially drives the second LED light emitting unit during a plurality of sections depending on the modulated AC voltage.

21. The LED lighting device of claim 19, wherein:

the second driving module comprises a pulse width modulating unit generating a pulse width modulated signal; and the second LED light emitting unit is driven by the pulse width modulated signal.

22. The LED lighting device of claim 19, wherein the dimmer is any one of a triode for alternating current (TRIAC) dimmer controlling a phase of AC power using a TRIAC, a pulse width modulation (PWM) dimmer, and an analog voltage dimmer changing the AC voltage.

23. The LED lighting device of claim 19, wherein the dimmer is a triode for alternating current (TRIAC) dimmer and is classified into a plurality of sections depending on phase-modulated magnitude.

24. The LED lighting device of claim 19, wherein the second LED light emitting unit comprises a red LED.

* * * * *